US006307460B1

(12) United States Patent
Yu

(10) Patent No.: US 6,307,460 B1
(45) Date of Patent: Oct. 23, 2001

(54) POWER SWITCH DEVICE

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 09/495,463

(22) Filed: Feb. 1, 2000

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/379, 79, 59, 337/76, 53, 66–69, 74, 75, 91, 39, 85, 112, 113, 140, 334, 345; 200/553–557

(56) References Cited

U.S. PATENT DOCUMENTS 3,358,099 * 12/1967 Bellomayre ..... 200/113
4,258,349 * 3/1981 Flory ..... 337/46
4,345,233 * 8/1982 Matthies ..... 337/75
4,528,538 * 7/1985 Andersen ..... 337/43
4,931,762 * 6/1990 Fierro ..... 337/66
4,937,548 * 6/1990 Sdunek ..... 337/70
5,012,495 * 4/1991 Munroe et al. .
5,223,813 * 6/1993 Cambreleng et al. ..... 337/66
5,262,748 * 11/1993 Tsung-Mou ..... 337/66
5,451,729 * 9/1995 Onderka et al. ..... 200/18
5,541,569 * 7/1996 Jang ..... 337/68
5,760,672 * 6/1998 Wang ..... 337/79
5,786,742 * 7/1998 Yin ..... 337/66
5,828,284 * 10/1998 Huang ..... 337/37
5,847,638 * 12/1998 Sorenson ..... 337/380
5,889,457 * 3/1999 Hsu et al. ..... 337/59
5,892,426 * 4/1999 Huang ..... 337/59
5,898,355 * 4/1999 Yu ..... 337/8
6,072,381 * 6/2000 Yu ..... 337/37
6,094,126 * 7/2000 Sorenson ..... 337/37
6,121,868 * 9/2000 Chiang ..... 337/37
6,154,116 * 11/2000 Sorenson ..... 337/37

FOREIGN PATENT DOCUMENTS

647094-A5 * 12/1984 (CH) ..... 337/333
19534611-A1 * 3/1996 (DE) ..... H01H/23/20
0694947-A1 * 1/1996 (EP) ..... H01H/71/54
2128028-A * 4/1984 (GB) .

* cited by examiner

*Primary Examiner*—Leo P. Picard
*Assistant Examiner*—Anatoly Vortman

(57) ABSTRACT

A power switch device includes a switch box with a button pivotally connected thereto which is pivotally connected to an actuating member. An engaging member is movably connected to the actuating member and removably engaged with a block. A head connected to the actuating member movably compresses a conduct plate so that when the conduct plate contacts a terminal plate, the circuit is closed. A bimetal plate connected to the terminal plate has a pushing end contacting the engaging member so that when the current is overloaded, the pushing end is thermally deformed to push the engaging member away from the block and the engaging member drops due to gravity. The head is then lifted to release the conduct plate from the terminal plate to open the circuit.

8 Claims, 5 Drawing Sheets

POWER SWITCH DEVICE

FIELD OF THE INVENTION

The present invention relates to a switch structure having an overload interruption structure so as to automatically open the circuit when the current is overloaded.

BACKGROUND OF THE INVENTION

The overload interruption structures equipped with a power switch device known to applicant are disclosed in U.S. Pat. Nos. 5,786,742, 5,223,813, 4,937,548, 4,661,667, 4,931,762, 5,451,729 and 4,704,594. In U.S. Pat. No. 4,937,548, a thermally deformed bimetal plate is operationally connected to a cam to open the circuit. However, the action to open the circuit takes time because the cam is indirectly operated by the bimetal plate so that there is a possibility that the electric current will destroy the electric equipment when the current is overload. Furthermore, an additional wire is required to connect between the bimetal plate and a conductive plate. In U.S. Pat. No. 5,786,742, the switch is directly connected to the conduct point so that the open action for the circuit is not fast enough to timely protect the equipment.

The present invention intends to provide a power switch device that has a simple structure and timely open the circuit to protect the electric equipment.

SUMMARY OF THE INVENTION

In accordance with one aspect of the present invention, there is provided a power switch device and comprised with a switch box having a button pivotally connected thereto and a tongue extending centrally from a bottom of the button. A first rod and a block respectively extend from an inside of the switch box. A first terminal plate and a second terminal plate are respectively engaged with the switch box and extend from the switch box. An inverted U-shaped bimetal plate having two legs respectively connected to the first terminal plate and a first end of a conduct plate. The other end of the bimetal plate is a pushing end. An actuating member has a head on a first end of the actuating member and an engaging member is movably mounted to a second end of the actuating member. A slot is defined through the head so that the head is movably mounted to the first rod received in the slot. The head presses on the second end of the conduct plate toward the second terminal plate. The tongue of the button is pivotally connected to the actuating member. A resilient plate has a first end thereof fixedly connected to the switch box and the other end of the resilient plate is engaged with one end of the button.

The object of the present invention is to provide a switch that has an actuating member which can be pushed by a pushing end of a bimetal plate FOR override, and the other end of the actuating member is then lifted to open the circuit.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
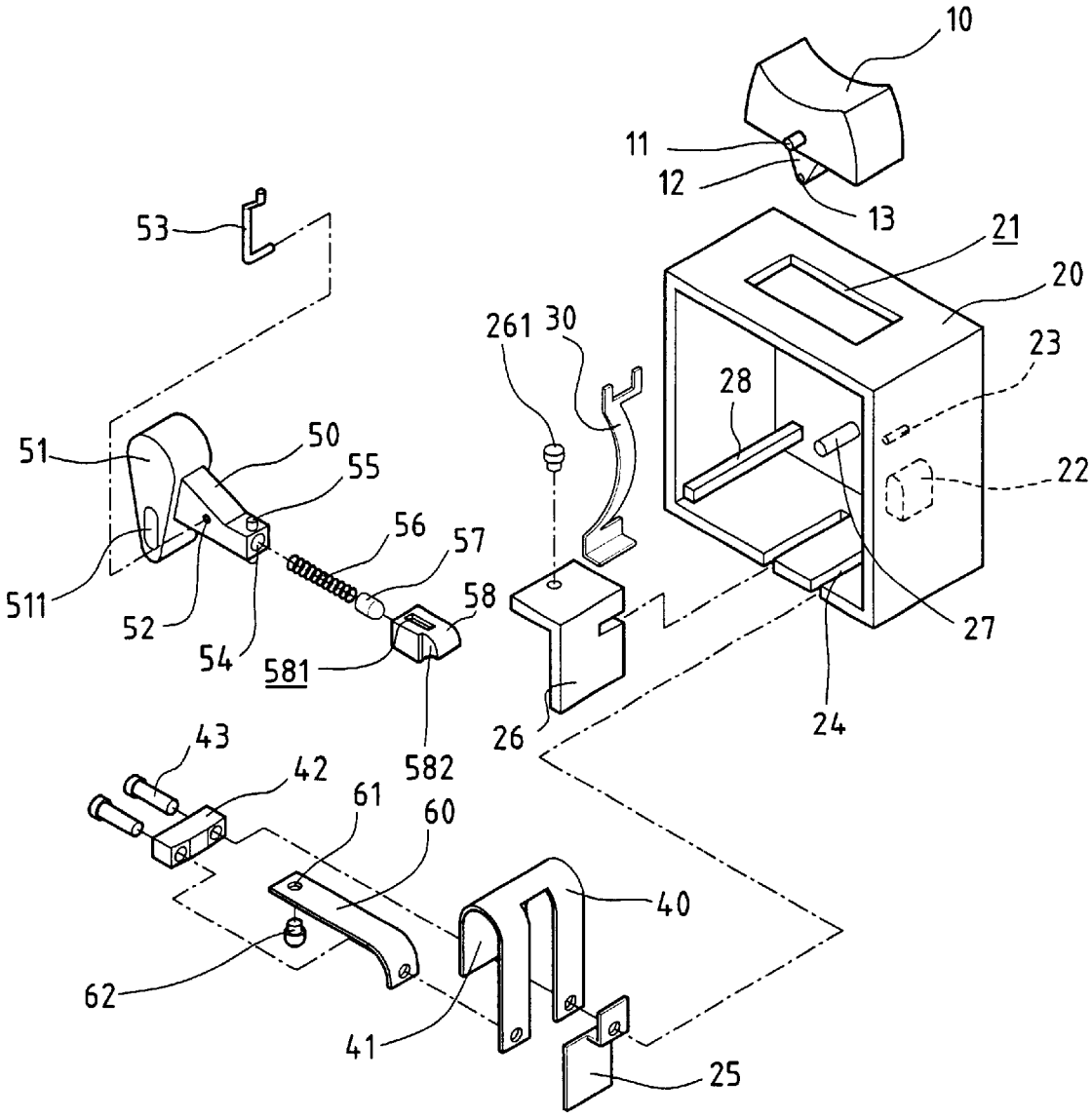
FIG. 1 is an exploded view to show the power switch device of the present invention.
Figure 2:
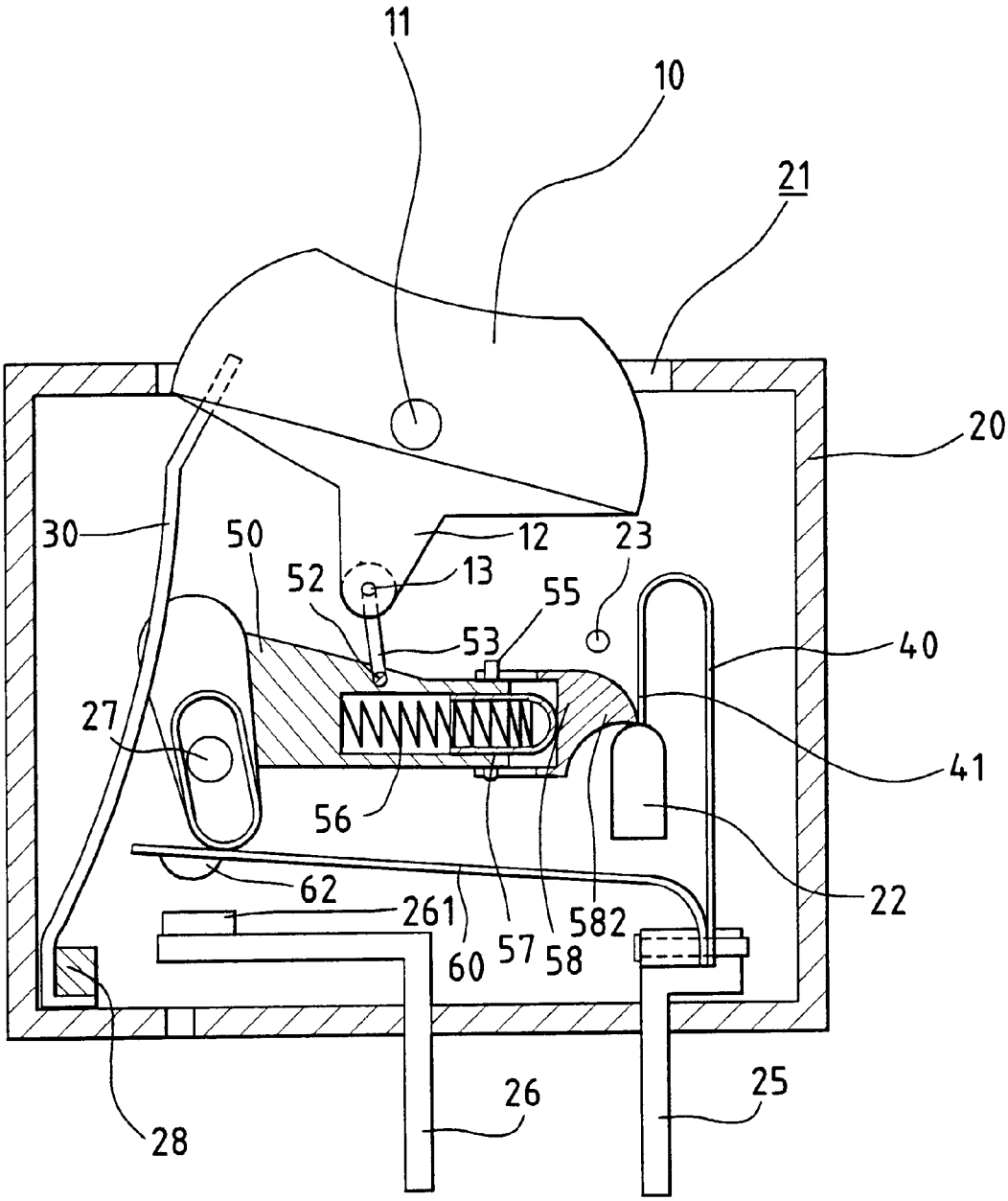
FIG. 2 is an illustrative view to show when the button is pushed to be in OFF state, wherein the conduct plate is not connected with the second terminal plate.

Referring to FIGS. 1 and 2, the power switch device in accordance with the present invention comprises a switch box 20 having an opening 21 in a top thereof so that a button 10 is pivotally connected to a top of the switch box 20 by a shaft 11 of the button 10. A tongue 12 extends centrally from a bottom of the button 10 and a hole 13 is defined in the tongue 12. A first rod 27, a second rod 28 and a block 22 respectively extend from an inside of the switch box 20. Two slits 24 are defined through a lower side of the switch box 20 so that a first terminal plate 25 and a second terminal plate 26 are respectively engaged with the two slits 24. The first terminal plate 25 and the second terminal plate 26 respectively extend from the switch box 20. A first conduct point 261 is connected to the second terminal plate 26.

An inverted U-shaped bimetal plate 40 has two legs on one end of the bimetal plate 40 and the other end of the bimetal plate 40 is a pushing end 41. One of the two legs is connected to the first terminal plate 25 and the other leg is connected to a first end of a conduct plate 60. A second conduct point 62 is connected to a second end of the conduct plate 60 at an aperture 61 of the second terminal plate 60. The two legs are fixedly positioned by a positioning member 42 fixed by two bolts 43.

An actuating member 50 has a head 51 on a first end of the actuating member 50 and an engaging member 58 is movably mounted to a second end of the actuating member 50. A first hole 52 is defined in a side of the actuating member 50 and a second hole 13 is defined in the tongue 12 of the button 10 so that a link 53 is pivotally connected between the first hole 52 and the second hole 13. In other words, the first hole 52 is the fulcrum of the actuating member 50. A slot 511 is defined through the head 51 so that the head 51 is movably mounted to the first rod 27 received in the slot 511. The lower end of the head 51 presses the second end of the conduct plate 60 toward the second terminal plate 26. Two protrusions 55 extend from the second end of the actuating member 50 and a concavity 54 is defined in the second end of the actuating member 50 for receiving a ball 57 and a spring 56 in the concavity 54. The engaging member 58 has a recess defined therein so that the second end of the actuating member 50 is received in the recess. Two longitudinal slots 582 are defined through a periphery defining the recess and the two protrusions 55 are movably received in the two longitudinal slots 582. Accordingly, the engaging member 58 can be moved relative to the second end of the actuating member 50. The engaging member 58 fisher has a hook 582 defined in a distal end thereof and the block 22 has a rounded top, the hook 582 disengageably engaged with the rounded top of the block 22. The pushing end 41 of the bimetal plate 40 contacts the hook 582. A resilient plate 30 has a first end thereof fixedly engaged with the second rod 28 in the switch box 20 and the other end of the resilient plate 30 is engaged with one end of the button 10.

Figure 3:
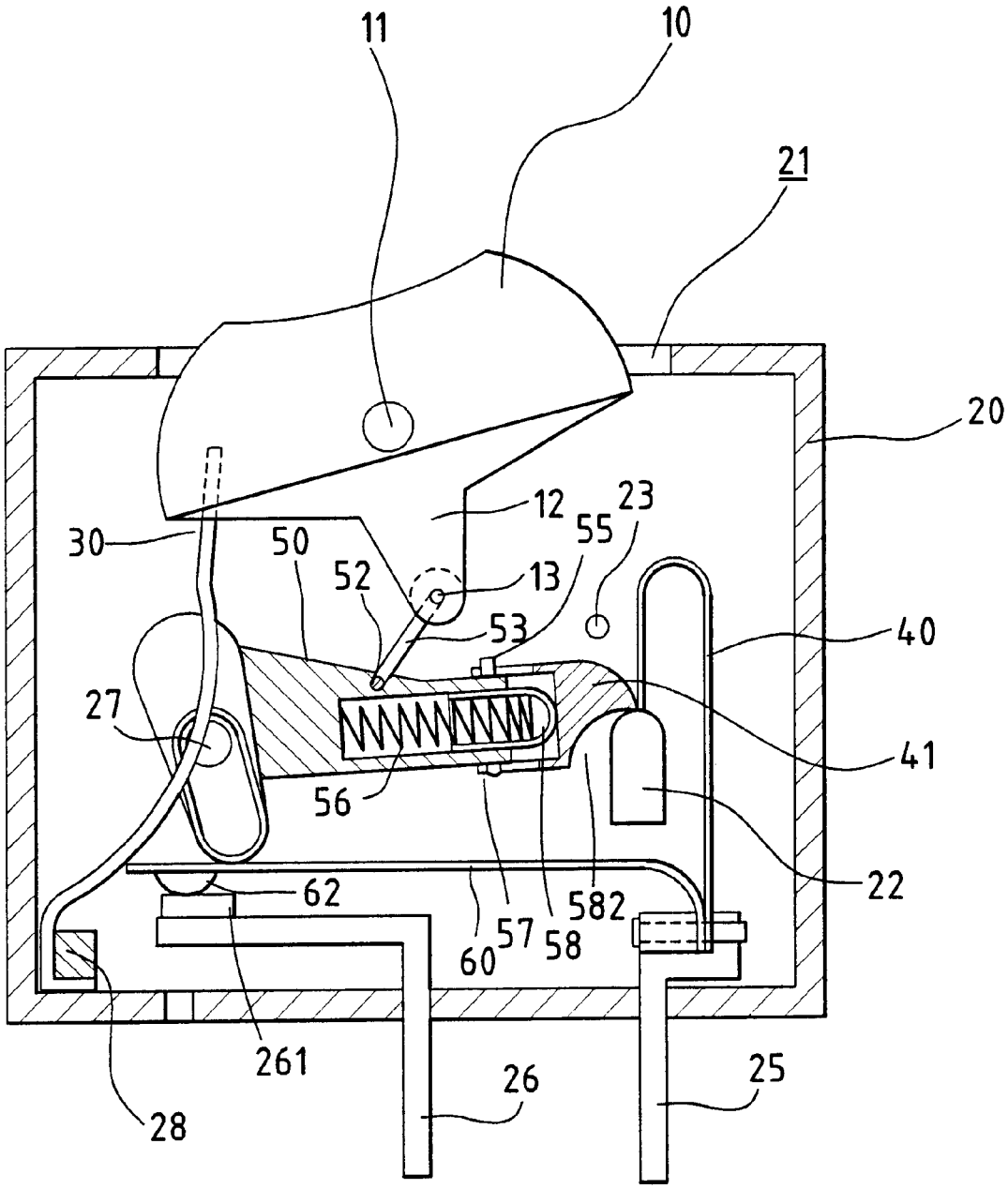
FIG. 3 is an illustrative view to show when the button is pushed to be in ON state, wherein the conduct plate is connected with the second terminal plate.

As shown in FIG. 3, when pushing the other end of the button 10, the resilient member 30 is deformed and the pivotal movement of the tongue 12 pushes the actuating member 50 to press the head 51 to let the first conduct point 261 contact the second conduct point 62 to close the circuit.

Figure 4:
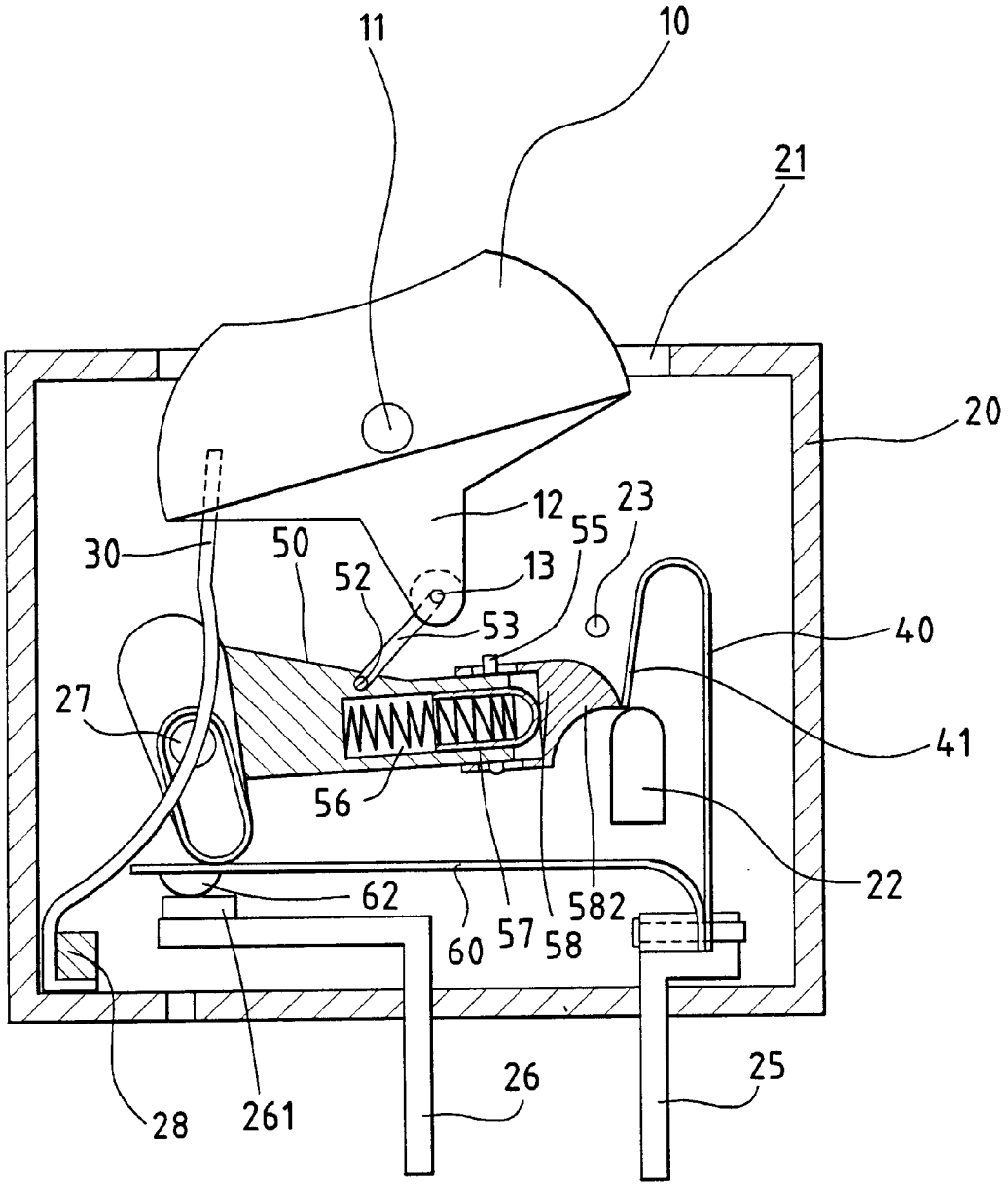
FIG. 4 is an illustrative view to show when the circuit is overloaded, the pushing end of the bimetal plate is thermally deformed to push the engaging member.
Figure 5:
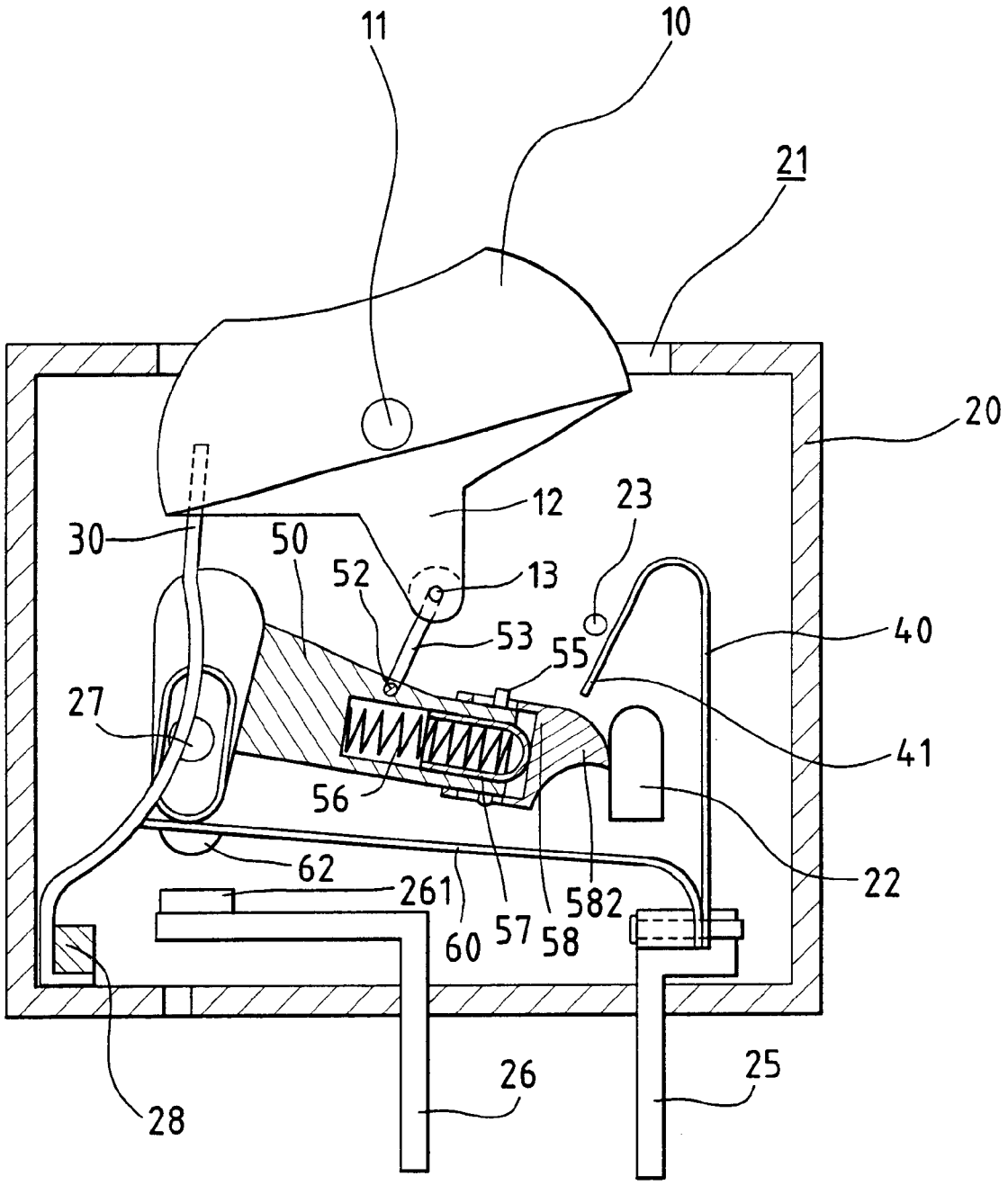
FIG. 5 is an illustrative view to show the engaging member is pushed away from the block by the pushing end of the bimetal plate, and the head of the actuating member is lifted to let the conduct plate disengage from the second terminal plate.

As shown in FIG. 4, when the electric circuit is overloaded, the pushing end 41 of the bimetal plate 40 is thermally deformed to push the engaging member 58 away from the rounded top of the block 22 and the spring 56 is pressed. As shown in FIG. 5, when the engaging member 58 is not supported by the block 22, the second end of the actuating member 50 drops due to the gravity. The head 51 is then lifted to release the conduct plate 60 to let the second contact point 62 separate from the first contact point 261 to open the circuit. A limiting rod 23 extends from the inside of the switch box 20 and located beside the pushing end 41 of the bimetal plate 40 so as to prevent the pushing end 41 from over-movement.

The actions in opposite directions of the engaging member 58 and the head 51 are almost happening simultaneously so that the circuit is opened sharply and timely.

While we have shown and described various embodiments in accordance with the present invention, it should be clear to those skilled in the art that further embodiments may be made without departing from the scope and spirit of the present invention.

What is claimed is:

1. A power switch device comprising:

a switch box having a button pivotally connected to a top of said switch box, a tongue extending centrally from a bottom of said button, a first rod and a block respectively extending from an inside of said switch box, a first terminal plate and a second terminal plate respectively engaged with said switch box and extending from said switch box, a first conduct point connected to said second terminal plate;

an inverted U-shaped bimetal plate having two legs on one end of said bimetal plate and the other end of said bimetal plate being a pushing end, one of said two legs connected to said first terminal plate and the other leg connected to a first end of a conduct plate, a second conduct point connected to a second end of said conduct plate;

an actuating member having a head on a first end of said actuating member and an engaging member movably mounted to a second end of said actuating member, a slot defined through said head so that said head movably mounted to said first rod received in said slot, said head pressing said second end of said conduct plate toward said second terminal plate, said tongue of said button pivotally connected to said actuating member, and a resilient plate having a first end thereof fixedly connected to said switch box and the other end of said resilient plate engaged with one end of said button.

2. The switch as claimed in claim 1, wherein said engaging member has a hook defined in a distal end thereof and said block has a rounded top, said hook disengageably engaged with said rounded top of said block.

3. The switch as claimed in claim 1 further comprising a limiting rod extending from said inside of said switch box and located beside said pushing end of said bimetal plate.

4. The switch as claimed in claim 1 further comprising a first hole defined in a side of said actuating member and a second hole defined in said tongue of said button, a link having two ends thereof pivotally engaged with said first hole and said second hole.

5. The switch as claimed in claim 1 further comprising a second rod extending from said inside of said switch box, said first end of said resilient plate is engaged with said second rod.

6. The switch as claimed in claim 1 further comprising two protrusions extending from said second end of said actuating member and said engaging member having a recess defined therein so that said second end of said actuating member received in said recess, two longitudinal slots defined through a periphery defining said recess and said two protrusions movably received in said two longitudinal slots.

7. The switch as claimed in claim 6 further comprising a concavity defined in said second end of said actuating member, a ball and a spring respectively received in said concavity in said actuating member and said recess in said engaging member.

8. The switch as claimed in claim 1 further comprising two slits defined through a side of said switch box, said first terminal plate and said second terminal plate respectively engaged with said two slits.

* * * * *